US006312316B1

(12) United States Patent
Takahashi et al.

(10) Patent No.: US 6,312,316 B1
(45) Date of Patent: Nov. 6, 2001

(54) CHEMICAL MECHANICAL POLISHING APPARATUS AND METHOD

(75) Inventors: Kazuo Takahashi, Kawasaki; Matsuomi Nishimura, Ohmiya; Kyoichi Miyazaki; Shinzo Uchiyama, both of Utsunomiya, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/306,822

(22) Filed: May 7, 1999

Related U.S. Application Data

(62) Division of application No. 08/853,418, filed on May 9, 1997, now Pat. No. 6,179,695.

(30) Foreign Application Priority Data

| | | |
|---|---|---|
| May 10, 1996 | (JP) | 8-140738 |
| May 10, 1996 | (JP) | 8-141080 |
| Jul. 2, 1996 | (JP) | 8-191446 |
| May 7, 1997 | (JP) | 9-132765 |
| May 7, 1997 | (JP) | 9-132888 |

(51) Int. Cl.[7] ..... B24B 7/22
(52) U.S. Cl. ..... 451/41; 451/271
(58) Field of Search ..... 451/41, 5, 288, 451/287, 57, 65, 271

(56) References Cited

U.S. PATENT DOCUMENTS

| | | | | |
|---|---|---|---|---|
| 2,629,975 | * | 3/1953 | Desenberg | 451/159 |
| 4,128,968 | * | 12/1978 | Jones | 451/5 |
| 4,826,271 | | 5/1989 | Takahashi et al. | 350/6.8 |
| 4,842,354 | | 6/1989 | Takahashi et al. | 350/6.8 |
| 4,956,944 | | 9/1990 | Ando et al. | 51/165.71 |
| 5,113,280 | | 5/1992 | Kawasaki et al. | 359/196 |
| 5,399,233 | | 3/1995 | Murazumi et al. | 156/635 |
| 5,792,709 | | 8/1998 | Robinson et al. | 451/287 |
| 5,800,253 | | 9/1998 | Ikemoto | 451/271 |
| 5,931,722 | * | 8/1999 | Ohmi et al. | 451/287 |
| 5,934,979 | * | 8/1999 | Talieh | 451/41 |

FOREIGN PATENT DOCUMENTS

| | | | |
|---|---|---|---|
| 2819828 | 11/1978 | (DE) | 451/259 |

* cited by examiner

*Primary Examiner*—Robert A. Rose
(74) *Attorney, Agent, or Firm*—Fitzpatrick, Cella, Harper & Scinto

(57) ABSTRACT

A chemical mechanical polishing apparatus and method can polish a surface of an object very precisely at a high speed irrespective of the presence of a local defect on the surface to be polished. By using a multiplex ring-shaped polishing pad, an effective surface to be polished is increased, and very precise and uniform polishing can be performed at a high speed. By using a plurality of polishing pads, having different diameters smaller than the diameter of the surface to be polished, provided with an interval on the same revolution radius on a revolution table, or by using a plurality of polishing pads, having the same diameter smaller than the diameter of the surface to be polished, provided at positions having different revolution radii on a revolution table, very precise and uniform polishing can be performed.

30 Claims, 12 Drawing Sheets

CHEMICAL MECHANICAL POLISHING APPARATUS AND METHOD

This application is a divisional of application Ser. No. 08/853,418, filed May 9, 1997 now U.S. Pat. No. 6,179,695.

BACKGROUND OF THE INVENTION

1. Field of the Invention

This invention relates to a chemical mechanical polishing apparatus and method for precisely and efficiently polishing a substrate, such as a wafer or the like.

2. Description of the Related Art

Recently, as semiconductor devices are going to have ultrafine patterns and high steps, it is requested to very precisely flatten the surface of a substrate, such as an SOI (silicon on insulator) substrate, a semiconductor wafer of Si, GaAs, InP or the like. Chemical mechanical polishing (CMP) apparatuses, such as one to be described below, are known as processing means for very precisely flattening the surface of a substrate, such as the above-described one or the like.

As shown in FIG. 13, a conventional chemical mechanical polishing apparatus includes a table 3 for rotating an object to be processed which can detachably hold a substrate 4, such as a wafer or the like, on a lower surface thereof, a polishing-tool rotating table 1 having an integrally-provided polishing pad 2, having a diameter larger than the diameter of the substrate 4, disposed below the rotating table 3 so as to face it, and supply nozzle 6 for supplying the upper surface of the polishing pad 2 with an abrasive (polishing slurry) 7. The substrate 4 is polished by providing the rotating table 3, holding the substrate 4, with a rotating movement indicated by an arrow B and a swinging movement indicated by a two-headed arrow C in a state of pressing the substrate 4 against the polishing pad 2. A shaft 5 rotates the rotating table 3 with a processing pressure in an axial direction indicated by a block arrow while rotating the upper surface of the polishing pad 2, provided as one body with the polishing-tool rotating table 1, in the direction of an arrow A with the abrasive (polishing slurry) 7.

In the above-described conventional approach, however, since the diameter of the polishing-tool rotating table having the polishing pad provided as one body therewith is larger than the diameter of the substrate, the following unsolved problems are present.

(1) The size of the polishing apparatus including the polishing-tool rotating table becomes large, and vibration occurs if the polishing-tool rotating table is rotated at too high a speed and hinders the very precise polishing of the surface to be polished of the substrate, serving as the object to be processed. Hence, the polishing-tool rotating table cannot be rotated at a high speed. As a result, the polishing speed (the amount of removal per unit time) cannot be increased, thereby increasing the processing cost.

(2) Since the substrate, serving as the object to be processed, is polished in a state in which the entire surface to be polished of the substrate contacts the polishing surface of the polishing pad, it is difficult to efficiently remove a local defect on the surface to be polished of the substrate if such a defect is present.

SUMMARY OF THE INVENTION

It is an object of the present invention to provide a chemical mechanical polishing apparatus and method which can very precisely polish a surface to be polished of an object to be processed at a high speed irrespective of the presence of local defects, and which can efficiently polish the entire surface to be polished while increasing the effective contact area being polished, and which can improve the uniformity of polishing.

According to one aspect, the present invention which achieves the above-described object relates to a chemical mechanical polising apparatus for polishing a surface of an object while supplying an abrasive between the surface to be polished and a polishing surface of a polishing tool brought in contact with the surface to be polished with a predetermined processing pressure. The polishing tool includes a multiplex ring-shaped pad including a plurality of coaxially disposed ring-shaped polising pads having different diameters, and coaxially disposed cylindrical shafts for holding corresponding ones of the plurality of ring-shaped polishing pads.

According to another aspect, the present invention which achieves the above-described object relates to a chemical mechanical polishing apparatus for polishing a surface of an object by revolving and rotating a polishing surface of a polishing tool, brought in contact with the surface to be polished with a predetermined processing pressure, while supplying an abrasive between the surface to be polished and the polishing surface of the polishing tool. The polishing tool includes a multiplex ring-shaped pad including a plurality of coaxially disposed ring-shaped polishing pads having different diameters, and coaxially disposed cylindrical shafts for holding corresponding ones of the plurality of ring-shaped polishing pads. A rotation driving mechanism/linear driving mechanism for causing a corresponding one of the ring-shaped polishing pads to rotate and to move in an axial direction is connected to a corresponding one of the plurality of cylindrical shafts.

According to still another aspect, the present invention which achieves the above-described object relates to a chemical mechanical polishing apparatus, including a rotating table for rotating an object to be processed while detachably holding it, a slider for moving the rotating table in a radial direction while holding it, a revolution table for holding a plurality of polishing-tool units arranged with an equal interval in a circumferential direction so as to be rotatable and to be movable in an axial direction, a revolution driving mechanism for revolving the revolution table, and rotation driving mechanisms/linear driving mechanisms each for causing a polishing surface of a corresponding one of the plurality of polishing-tool units to rotate and to move in an axial direction. The apparatus polishes a surface of the object while supplying an abrasive between the surface to be polished and the polishing surfaces of the plurality of polishing-tool units brought in contact with the surface to be polished of the object with a predetermined processing pressure. Each of the plurality of polishing-tool units includes a multiplex ring-shaped pad including a plurality of coaxially disposed ring-shaped polising pads having different diameters, and coaxially disposed cylindrical shafts for holding corresponding ones of the plurality of ring-shaped polishing pads. A rotation driving mechanism/linear driving mechanism is connected to a corresponding one of the plurality of coaxially disposed cylindrical shafts.

According to still another aspect, the present invention which achieves the above-described object relates to a chemical mechanical polishing method for polishing a surface of an object while supplying an abrasive between the surface to be polished and a polishing tool brought in contact with the object with a predetermined processing pressure. The method includes the steps of using a multiplex ring-shaped polising pad, including a plurality of coaxially disposed ring-shaped polishing pads having different diameters smaller than a diameter of the surface to be polished of the object to be processed, and polishing the surface to be polished by rotating and revolving the multiplex ring-shaped polishing pad in a state of contacting the surface to be polished of the object to be processed.

According to still another aspect, the present invention which achieves the above-described object relates to a chemical mechanical polishing apparatus for polishing a surface of an object while supplying an abrasive between the surface to be polished and a polishing surface of a polishing tool brought in contact with the surface of a polishing with a predetermined processing pressure. The apparatus includes a rotating table for rotating the object to be processed while holding it, a slider for moving the rotating table in a radial direction while holding it, a revolution table for supporting a plurality of polishing tools, having different diameters smaller than a diameter of the object to be processed, with an interval on the same revolution radius so as to be rotatable and to be movable in an axial direction, a revolution-table rotation driving mechanism for revolving the revolution table, and rotation driving mechanisms/linear driving mechanisms each for causing a corresponding one of the plurality of polishing tools to rotate and to move in axial direction.

According to still another aspect, the present invention which achieves the above-described object relates to a chemical mechanical polising method for polishing a surface of an object while supplying an abrasive between the surface to be polished and a polishing surface of a polishing tool brought in contact with the surface to be polishing with a predetermined processing pressure. The method includes the steps of preparing a plurality of polishing tools having respective polishing surfaces having different diameters smaller than a diameter of the surface to be polished of the object to be processed, and polishing the surface of the object by causing a polishing surface of a polishing tool selected from the plurality of polishing tools to revolve and rotate in a state of contacting the surface to be polished of the object to be processed.

According to still another aspect, the present invention which achieves the above-described object relates to a chemical mechanical polising apparatus for polishing a surface of an object while supplying an abrasive between the surface to be polished and a polishing surface of a polishing tool brought in contact with the surface to be polished with a predetermined processing pressure. The appararus includes a rotating table for rotating the object to be processed while holding it, a slider for moving the rotating table in a radial direction while holding it, a revolution table for supporting a plurality of polishing tools, having the same diameter smaller than a diameter of the object to be processed, at positions having different revolution radii so as to be rotatable and movable in an axial direction, a revolution driving mechanism for revolving the revolution table, and rotation driving mechanisms/linear driving mechanisms each for causing a corresponding one of the plurality of polishing tools to rotate and to move in the axial direction.

According to still another aspect, the present invention which achieves the above-described object relates to a chemical mechanical polising method for polishing a surface of an object while supplying an abrasive between the surface to be polished and a polishing surface of a polishing tool brought in contact with the surface to be polished with a predetermined processing pressure. The method includes the steps of preparing a plurality of polishing tools having respective polishing surfaces having the same diameter smaller than a diameter of the surface to be polished of the object to be processed, and polishing the surface of the object by causing a polishing surface of a polishing tool selected from the plurality of polishing tools to revolve and rotate in a state of contacting the surface to be polished of the object.

According to still another aspect, the present invention which achieves the above-described object relates to a chemical mechanical polising apparatus for polishing a surface of an object while supplying an abrasive between the surface to be polished and a polishing surface of a polishing tool brought in contact with the surface to be polished with a predetermined processing pressure. The apparatus includes a rotating table for rotating the object to be processed while holding it, a slider for moving the rotating table in a radial direction while holding it, a revolution table for supporting a plurality of polishing tools, having different diameters smaller than a diameter of the object to be processed, with an interval on the different revolution radius so as to be rotatable and to be movable in an axial direction, a revolution-table rotation driving mechanism for revolving the revolution table, and rotation driving mechanisms/linear driving mechanisms each for causing a corresponding one of the plurality of polishing tools to rotate and to move in an axial direction.

According to still another aspect, the present invention which achieves the above-described object relates to a chemical mechanical polising method for polishing a surface of an object while supplying an abrasive between the surface to be polished and a polishing surface of a polishing tool brought in contact with the surface to be polished with a predetermined processing pressure. The method includes the steps of preparing a plurality of polishing tools, having respective polishing surfaces having different diameters smaller than a diameter of the surface to be polished of the object to be processed, with an interval on the different revolution radius and polishing the surface to be polished of the object to be processed by causing a polishing surface of a polishing tool selected from the plurality of polishing tools to revolve and rotate in a state of contacting the surface to be polished of the object.

The foregoing and other objects, advantages and features of the present invention will become more apparent from the following detailed description of the preferred embodiments taken in conjunction with the accompanying drawings.

At one advantage, providing a diameter of the polishing pad smaller than that of the substrate to be polished reduces the vibration caused by the high speed rotation of the polishing tool. Consequently, polishing rate becomes increased.

As described in detail below, the choice of varied polishing methods allows the surface of the substrate to be entirely or partially polished with precision.

DETAILED DESCRIPTION OF THE PREFERRED EMBODIMENTS

A description will now be provided of preferred embodiments of the present invention with reference to the drawings.

First Embodiment

Figure 1:
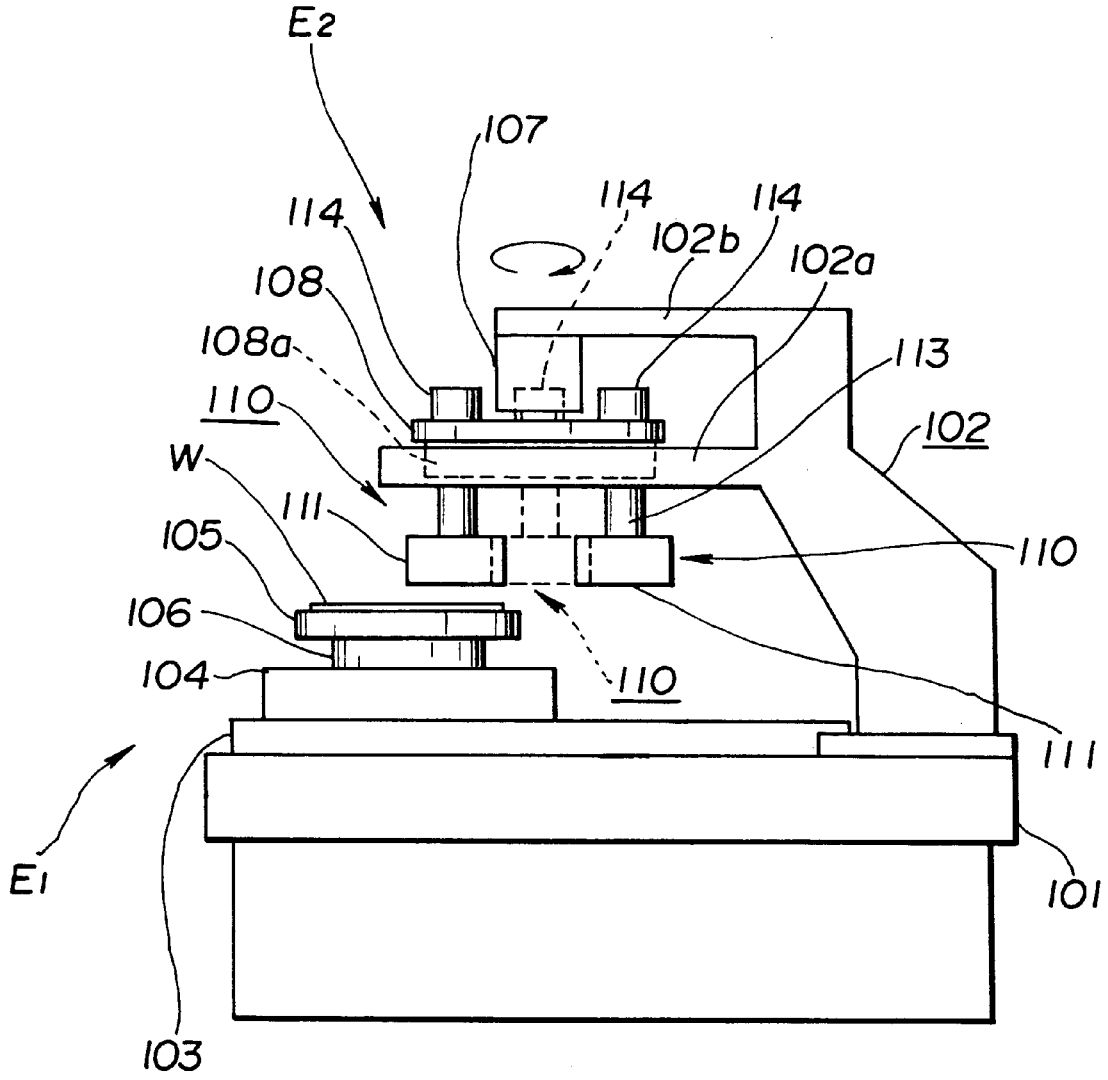
FIG. 1 is a schematic side view illustrating the configuration of a chemical mechanical polishing apparatus according to a first embodiment of the present invention.

As shown in FIG. 1, a chemical mechanical polishing apparatus according to a first embodiment of the present invention includes a polishing station $E_1$ for causing a substrate W to be processed, such as a wafer or the like, to rotate and to horizontally move in a radial direction while detachably holding it, and a polishing head $E_2$ for causing respective polishing pads of a plurality of polishing-tool units 110 disposed with an equal interval in a circumferential direction above the polishing station $E_1$ to revolve and rotate while supporting the polishing-tool units 110.

As shown in FIG. 1, the polishing station $E_1$ includes a slider 104 for moving a rotating table 105 in a radial direction while supporting it on the upper surface of a guide table 103 integrally provided on a base 101, a linear driving mechanism (not shown) for moving the slider 104, the rotating table 105 whose rotation shaft 106 is rotatably supported on the slider 104 via a radial bearing and a thrust bearing, and a rotation driving mechanism (not shown) for rotating the rotating table 105, so as to cause the substrate W to rotate and to move in a radial direction while detachably holding it on the upper surface of the rotating table 105.

The polishing head $E_2$ includes a revolution table 108 rotatably supported on a lower yoke 102*a*, extended above the polishing station $E_1$, of a supporting member 102, planted on the base 101, via a radial bearing and a thrust bearing, and the three small-diameter polishing-tool units 110 which are disposed with an equal interval in a circumferential direction on the revolution table 108 and whose shafts 113 are supported so as to be rotatable and to be movable in a radial direction via bearings. The revolution table 108 is fixed on an output shaft of a revolution-table rotation driving mechanism 107 supported on an upper yoke 102*b* of the supporting member 102, and is revolved at a predetermined revolution speed to cause the polishing-tool units 110 to revolve.

Figure 2:
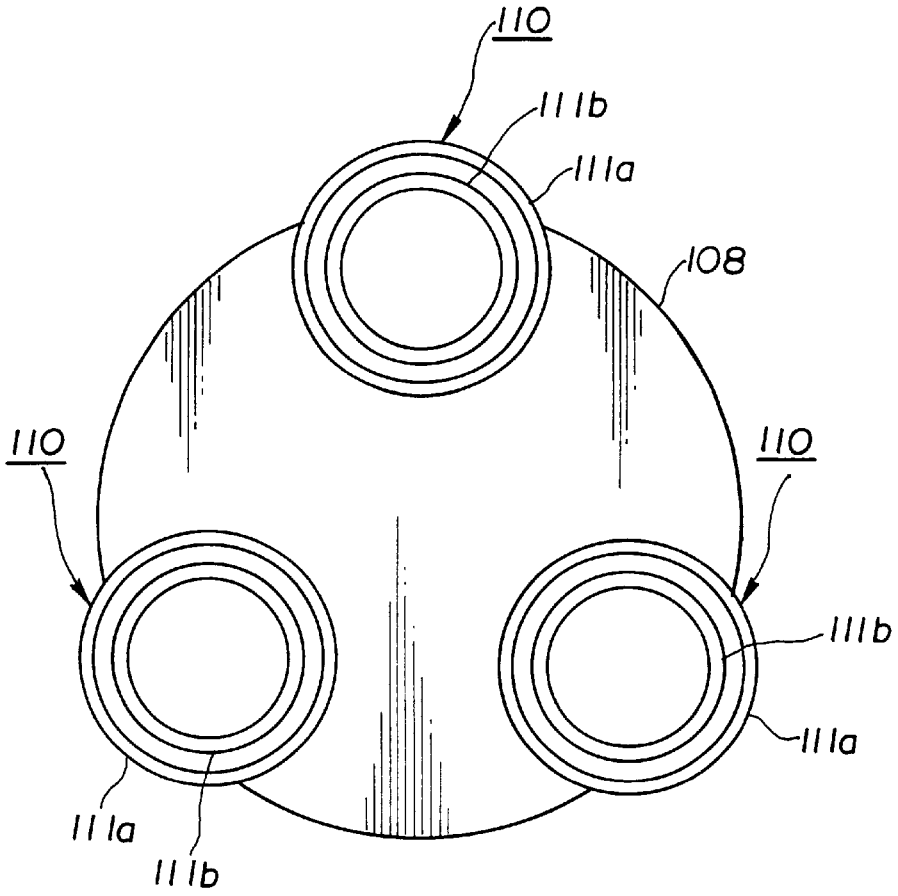
FIG. 2 is a diagram illustrating the relationship between a revolution table and each polishing-tool unit having a duplex ring-shaped polishing pad in the chemical mechanical polishing apparatus shown in FIG. 1.
Figure 3:
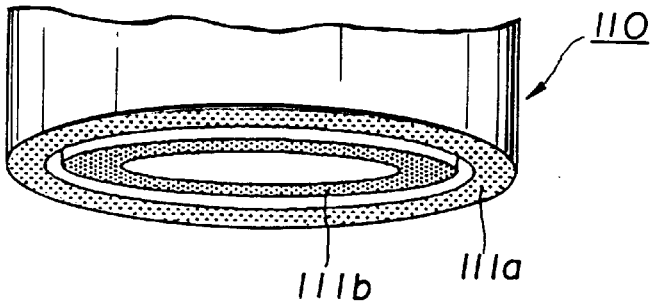
FIG. 3 is a perspective view illustrating the lower surface of the duplex ring-shaped polishing pad shown in FIG. 2.
Figure 4:
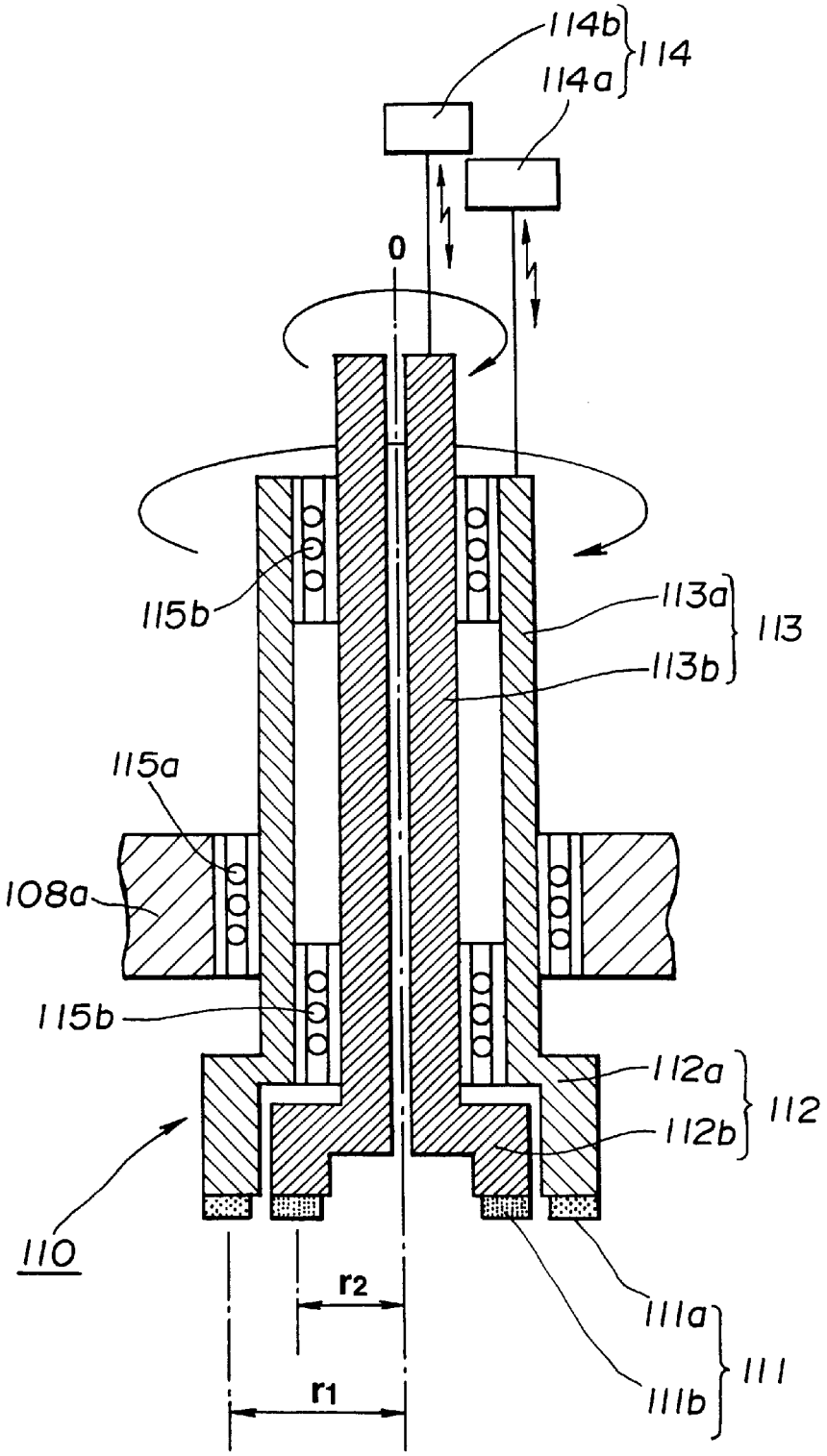
FIG. 4 is a schematic cross-sectional view illustrating the configuration of the polishing-tool unit having the duplex ring-shaped polishing pad shown in FIG. 2.

The three polishing-tool units 110 have the same configuration, which will be described with reference to FIGS. 2 through 4. The polishing-tool unit 110 includes a ring-shaped polishing pad 111 and a shaft 113. An outer cylindrical shaft 113*a* of the shaft 113 is disposed so as to be rotatable and to be movable in a radial direction with respect to a lower supporting member 108*a* formed as one body with the revolution table 108 via bearings. An inner cylindrical shaft 113*b* of the shaft 113 is coaxially disposed within the outer cylindrical shaft 113*a* so as to be rotable and to be movable in a radial direction with respect to the outer cylindrical shaft 113*a* via bearings 115*b*. Polishing-pad holding members 112*a* and 112*b* having desired diameters are formed at lower portions of the cylindrical shafts 113*a* and 113*b*, respectively, and ring-shaped polishing pads 111*a* and 111*b* are integrally mounted on the lower surfaces of the polishing-pad holding members 112*a* and 112*b*, respectively. As shown in FIGS. 2 and 3, the ring-shaped polishing pads 111*a* and 111*b* have different diameters and are coaxially arranged.

Rotation driving mechanisms/linear driving mechanisms 114*a* and 114*b* (or rotation/linear driving mechanisms) mounted on the revolution table 108 are connected to the upper ends of the cylindrical shafts 113*a* and 113*b*, respectively. Thus, the ring-shaped polishing pads 111*a* and 111*b* can be independently rotated at high speeds and linearly moved in radial directions by the rotation driving mechanisms/linear driving mechanisms 114*a* and 114*b*, respectively, and can be brought in contact with the surface to be polished of the substrate W with a predetermined pressure or can be separated from the surface to be polished of the substrate W.

The number of rotations of the two ring-shaped polishing pads 111*a* and 111*b* having different diameters can be set so as to provide the same rotational circumferential speed. That is, if the radii of the ring-shaped polishing pads 111*a* and 111*b* are represented $r_1$ and $r_2$, respectively, the number of rotations of the outer rotation driving mechanism/linear driving mechanism 114*a* and the polishing pad 111*a* is represented by $n_1$, and the number of rotations of the inner rotation driving mechanism/linear driving mechanism 114*b* and the polishing pad 11*b* is represented by $n_2$, the numbers of rotation of the respective components are set so as to satisfy the relationship of $r_1 \cdot n_1 = r_2 \cdot n_2$. Accordingly, the number of rotation of the polishing pad increases as the radius of the polishing pad decreases.

Next, the operation of the first embodiment will be described. When performing chemical mechanical polishing using the inner and outer ring-shaped polishing pads 111*a* and 111*b*, the substrate W is detachably held on the upper surface of the rotating table 105. Then, the slider 104 is moved in a radial direction to a position where the polishing pads 111 of the polishing-tool units 110 contact the substrate W.

Then, by operating the rotation driving mechanism/linear driving mechanisms 114*a*, 114*b*, the respective inner and outer ring-shaped polishing pads 111*a* and 111*b* of the polishing-tool units 110 are integrally moved downward in the axial direction toward the substrate W, and the polishing pads 111*a*, 111*b* are brought in contact with the surface to be polished of the substrate W so as to provide a predetermined processing pressure. While supplying an abrasive (polishing slurry) from abrasive (polishing slurry) supply means (not shown) between the substrate W and the polishing pads 111*a*, 111*b*, the inner and outer ring-shaped polishing pads 111*a*, 111*b* are revolved by the revolution-table rotation driving mechanism 107, and the ring-shaped polishing pads 111*a* and 111*b* are rotated at high speeds by the rotation driving mechanisms/linear driving mechanisms 114*a* and 114*b*, respectively. At the same time, the rotating table 105 is rotated and is swung in radial directions with a short stroke to perform chemical mechanical polishing.

As described above, when polishing the substrate W by simultaneously operating the inner and outer ring-shaped polishing pads 111*a* and 111*b* of each of the polishing-tool units 110, the inner and outer ring-shaped polishing pads 111*a* and 111*b* rotate at the same circumferential speed. Hence, it is possible to increase the effective contact surface and the effective surface being polished, and to efficiently perform high-precision polishing.

In the polishing-tool unit 110 of the first embodiment, since the inner and outer ring-shaped polishing pads 111*a* and 111*b* can move with respect to each other in an axial direction, it is possible to adjust the relative heights of the polishing pads 111*a* and 111*b*, to independently adjust and set the pressures of the inner and outer ring-shaped polishing pads 111*a* and 111*b* against the surface to be polished, and therefore to set optimum processing pressures for the respective polishing pads in accordance with the state of the surface to be polished of the substrate.

Since the surface to be polished of the substrate is polished by partially contacting the multiplex ring-shaped polishing pads having a small diameter thereto, it is possible to rotate the polishing pads at high speeds, and to very precisely polish the surface to be polished at a high speed irrespective of the presence of a local defect on the surface to be polished.

Although in the foregoing description, both of the inner and outer ring-shaped polishing pads 111*a* and 111*b* are used for polishing, only one of the ring-shaped polishing pads having different diameters may be selected and brought in contact with the surface to be polished of the object to be processed to perform polishing, because the polishing pads can be relatively moved in an axial direction.

Although in the first embodiment, a duplex ring-shaped polishing pad has been illustrated as ring-shaped polishing pads, the structure of the ring-shaped polishing pads is not limited to the duplex type, but any other multiplex ring-shaped polishing pads besides the duplex-type pad may also be used. Furthermore, the number of polishing tools is not limited to 3, but any other appropriate number may be selected.

Furthermore, instead of the ring-shaped pad which is continuous along the circumference as shown in FIGS. 2 and 3, a discontinuous ring-shaped pad in which a plurality of segments are arranged along the circumference with an interval may also be used.

For example, a semiconductor wafer of Si, Ge, GaAs, InP or the like, or a quartz or glass substrate on the surface of which a plurality of island-like semiconductor regions are formed is suitable as an object to be processed according to the polishing method of the first embodiment.

All of the above-described substrates require a flat surface in order to form interconnections and insulating regions patterned using photolithography. Accordingly, the surface to be polished comprises and insulating film, a metal film or a surface in which an insulating film and a metal film are mixed.

It is desirable to utilize the surface of a pad made of a nonwoven fabric, foamed polyurethane or the like as the polishing surface of the polishing tool of the first embodiment.

A liquid containing fine particles is desirable as an abrasive used in the first embodiment. More specifically, it is desirable to use silica ($SiO_2$), alumina ($Al_2O_3$), manganese oxide ($MnO_2$), cerium oxide (CeO) or the like for the fine particles, and to use a liquid containing NaOH, KOH, $H_2O_2$ or the like as the liquid.

The diameter of the fine particles is preferably 8 nm–50 nm. The degree of agglomeration of the particles can be controlled, for example, by changing the value of pH of KOH.

When polishing the surface of a semiconductor, a sodium hydroxide solution in which silica particles are dispersed is preferable. When polishing an insulating film, a potassium hydroxide solution in which silica particles are dispersed is preferable. When polishing a metal film of tungsten or the like, an aqueous solution of hydrogen peroxide in which alumina or manganese oxide particles are dispersed is preferable.

For example, when polishing the surface of a semiconductor, if an aqueous solution of NaOH in which silica particles are dispersed is used as the abrasive, the surface of silicon reacts on NaOH to form a $Na_2SiO_3$ layer. The reaction proceeds by removing the formed layer by mechanical polishing by the silica particles and a polishing cloth to expose a new silicon surface. Accordingly, such a mechanism is called chemical mechanical polishing.

Second Embodiment

Figure 5:
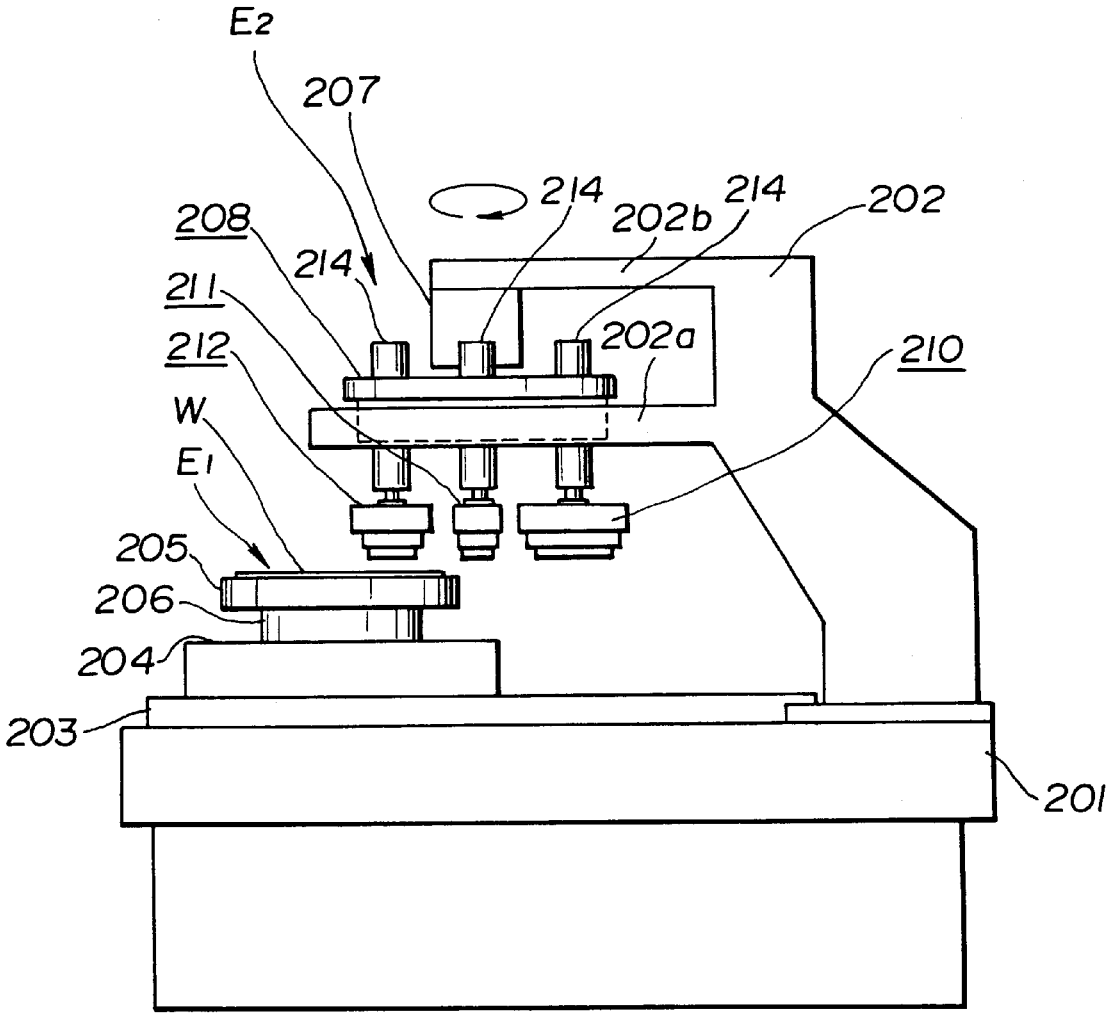
FIG. 5 is a schematic side view illustrating the configuration of a chemical mechanical polishing apparatus according to a second embodiment of the present invention.

As shown in FIG. 5, a chemical mechanical polishing apparatus according to a second embodiment of the present invention includes a polishing station $E_1$ for causing a substrate W to be processed, such as a wafer or the like, to rotate and to move in a radial direction while detachably holding it, and a polishing head $E_2$ for causing first through fourth polishing tools 210–213, serving as a plurality of polishing tools, disposed above the polishing station $E_1$ to revolve and rotate while supporting the polishing tools 210–213.

Figure 7:
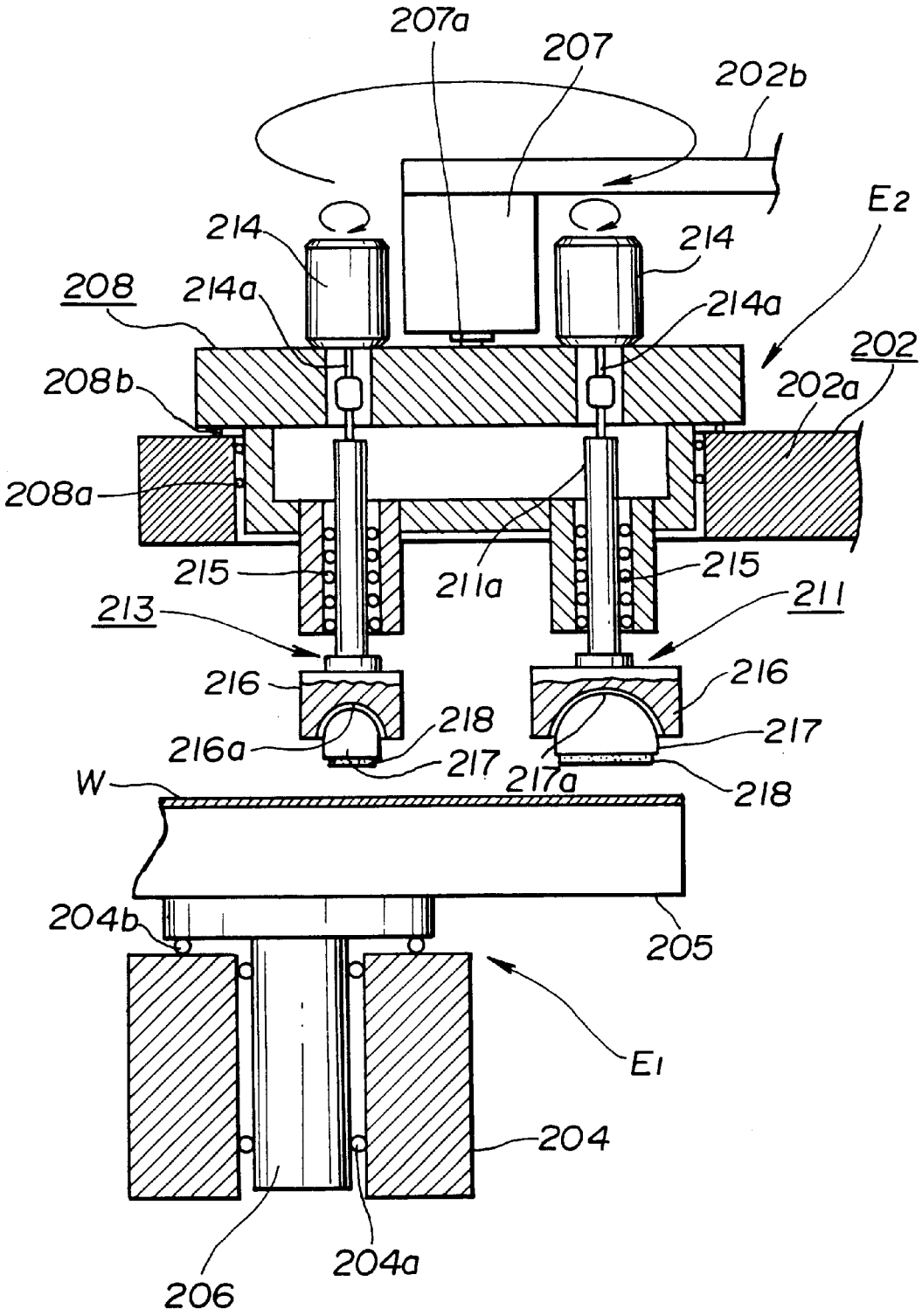
FIG. 7 is a schematic partial cross-sectional view of the chemical mechanical polishing apparatus shown in FIG. 5 taken along line I—I shown in FIG. 6.

As shown in FIGS. 5 and 7, the polishing station $E_1$ includes a slider 204 for moving a rotating table 205 in a radial direction while supporting it on the upper surface of a guide table 203 integrally provided on a base 201, a linear driving mechanism (not shown) for moving the slider 204, the rotating table 205 whose rotation shaft 206 is rotatably supported on the slider 204 via a radial bearing 204*a* and a thrust bearing 204*b*, and a rotation driving mechanism (not shown) for rotating the rotating table 205, so as to cause the substrate W to rotate and to move in a radial direction while detachably holding it on the upper surface of the rotating table 205.

The polishing head $E_2$ includes a revolution table 208 rotatably supported on a lower yoke 202*a*, extended above the polishing station $E_1$, of a supporting member 202, planted on the base 201, via a radial bearing 208*a* and a thrust bearing 208*b*, and the first through fourth polishing tools 210–213 which are supported on four portions present with an interval on the same revolution radius on the revolution table 208 so as to be rotatable and to be movable in a radial direction via bearings 215.

The revolution table 208 is fixed on an output shaft 207*a* of a revolution-table rotation driving mechanism 207 supported on an upper yoke 202*b* of the supporting member 202, and is revolved at a predetermined revolution speed.

The first through fourth polishing tools 210–213 may have the same configuration except that they have different diameters. Hence, a description will be provided of the second polishing tool 211 shown in FIG. 7.

The upper end of a shaft 211*a* of the second polishing tool 211 is connected to an output shaft 214*a* of a rotation driving mechanism/linear driving mechanism 214. A polishing-pad holding member 217 is connected to the lower end of the shaft 211*a* via a connecting member 216. A polishing pad 218 is integrally mounted on the lower surface of the polishing-pad holding member 217. It is thereby possible to cause the second polishing tool 211 to rotate at a high speed and to move in an axial direction, thereby causing the polishing pad 218 to contact the surface to be polished of the substrate W with a predetermined processing pressure or to separate from the surface to be polished of the substrate W.

The connecting member 216 and the polishing-pad holding member 217 constitute a so-called equalizing mechanism in which a convex hemispherical surface 217*a* of the polishing-pad holding member 217 is slidably fitted to a concave hemispherical surface 216*a* of the connecting member 216. Accordingly, the surface contacting the substrate W, i.e., the polishing surface, of the polishing pad 218 is inclined in accordance with the inclination of the surface to be polished of the substrate W, serving as the object to be processed.

The same reference numerals are given to the same portions of the remaining first, third and fourth polishing tools 210, 212 and 213, and a description thereof will be omitted.

Figure 6:
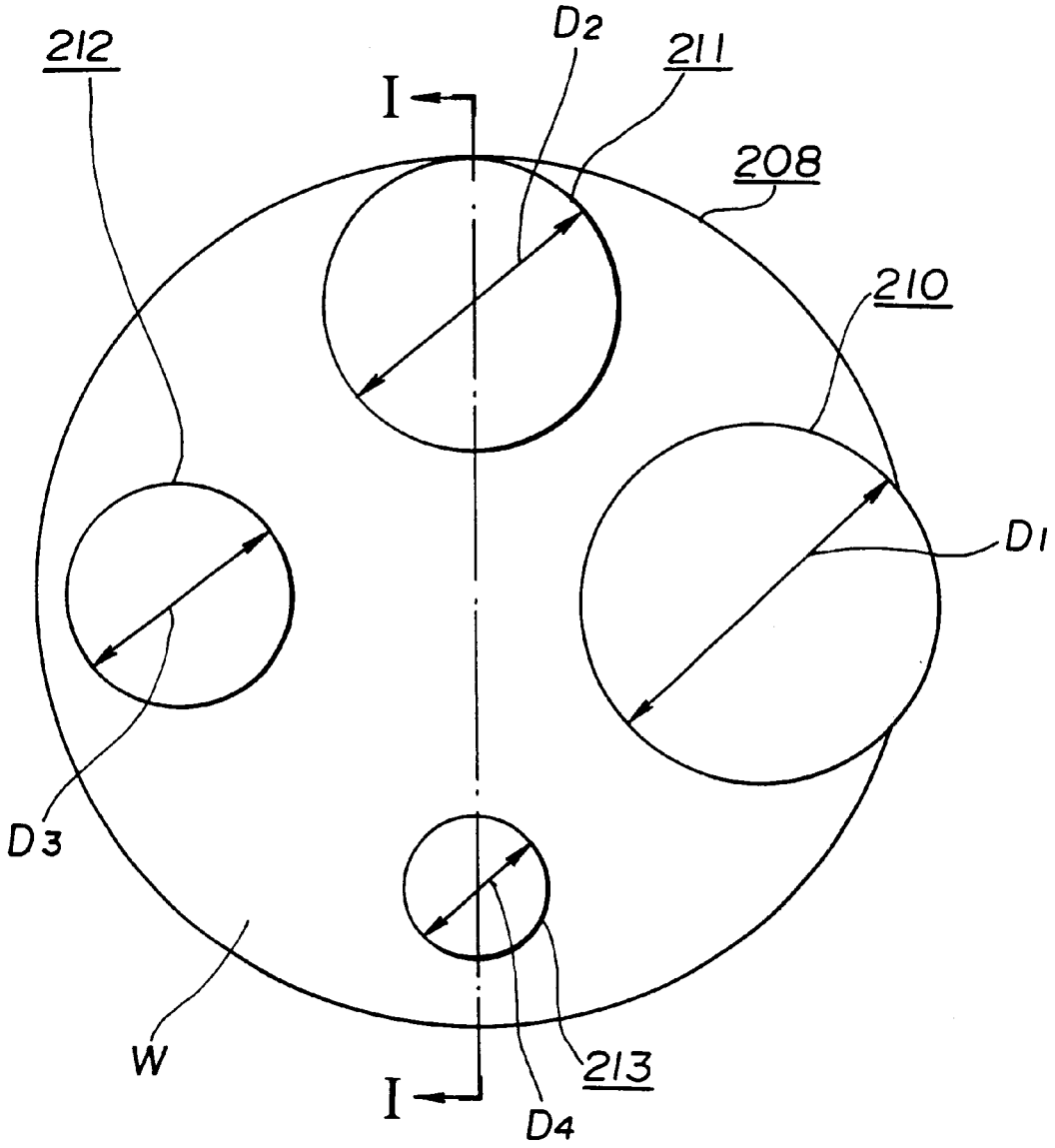
FIG. 6 is a diagram illustrating the diameters and revolution radii of respective polishing tools in the chemical mechanical polishing apparatus shown in FIG. 5.

In the second embodiment, as shown is FIG. 6, if the diameters of the first, second, third and fourth polishing tools 210, 211, 212 and 213 are represented by $D_1$, $D_2$, $D_3$ and $D_4$, respectively, the relationship of $D_1>D_2>D_3>D_4$ holds, and the diameters of the first through fourth polishing tools 210–213 are set to be smaller than the diameter of the substrate W.

Next, a description will be provided of the operation of the above-described chemical mechanical polishing apparatus.

(1) The substrate W is detachably held on the upper surface of the rotating table 205. Then, by moving the slider 204 in a radial direction, the polishing pads 218 of the first through fourth polishing tools 210–213 are set to positions where all of them contact the substrate W.

(2) Then, a polishing tool having a diameter corresponding to a region to be polished on the surface of the substrate W, such as a wafer or the like, serving as the object to be processed, from among the first through fourth polishing tools 210–213 is linearly moved and brought in contact with the surface of the substrate W with a predetermined processing pressure. While supplying an abrasive (polishing slurry) from abrasive (polishing slurry) supply means (not shown) between the substrate W and the polishing pads 218, the polishing tool is rotated and revolved. At the same time, the rotating table 205 is rotated and is swung in radial directions with a short stroke to perform chemical mechanical polishing.

In the second embodiment, the number of polishing tools is not limited to the above-described number, i.e., 4, but may be 2, 3, or 5 or more. Furthermore, the rotation speed and the processing pressure of each of the polishing tools can be changed.

For example, a semiconductor wafer of Si, Ge, GaAs, InP or the like, or a quartz or glass substrate on the surface of which a plurality of island-like semiconductor regions are formed is suitable as an object to be processed according to the polishing method of the first embodiment.

All of the above-described substrates require a flat surface in order to form interconnections and insulating regions patterned using photolithography. Accordingly, the surface to be polished comprises an insulating film, a metal film, or a surface in which an insulating film and a metal film are mixed.

It is desirable to utilize the surface of a pad made of a nonwoven fabric, foamed polyurethane or the like as the polishing surface of the polishing tool of the second embodiment.

A liquid containing fine particles is desirable as an abrasive used in the second embodiment. More specifically, it is desirable to use silica ($SiO_2$), alumina ($Al_2O_3$), manganese oxide ($MnO_2$), cerium oxide (CeO) or the like for the fine particles, and to use a liquid containing NaOH, KOH, $H_2O_2$ or the like as the liquid.

The diameter of the fine particles is preferably 8 nm–50 nm. The degree of agglomeration of the particles can be controlled, for example, by changing the value of pH of KOH.

When polishing the surface of a semiconductor, a sodium hydroxide solution in which silica particles are dispersed is preferable. When polishing an insulating film, a potassium hydroxide solution in which silica particles are dispersed is preferable. When polishing a metal film of tungsten or the like, an aqueous solution of hydrogen peroxide in which alumina or manganese oxide particles are dispersed is preferable.

For example, when polishing the surface of a semiconductor, if an aqueous solution of NaOH in which silica particles are dispersed is used as the abrasive, the surface of silicon reacts on NaOH to form a $Na_2SiO_3$ layer. The reaction proceeds by removing the formed layer by mechanical polishing by the silica particles and the polishing cloth to expose a new silicon surface. Accordingly, such a mechanism is called chemical mechanical polishing.

Third Embodiment

Figure 8:
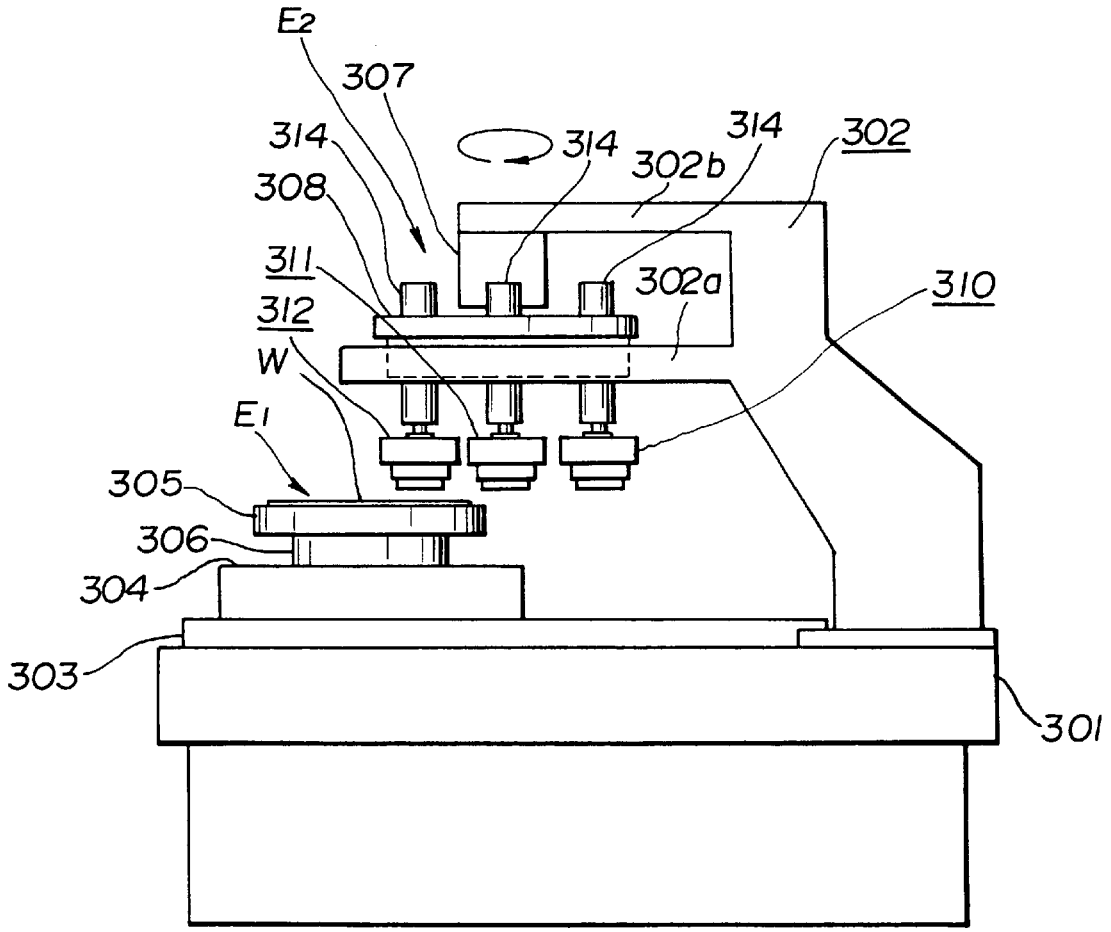
FIG. 8 is a schematic side view illustrating the configuration of a chemical mechanical polishing apparatus according to a third embodiment of the present invention.

As shown in FIG. 8, a chemical mechanical polishing apparatus according to a third embodiment of the present invention includes a polishing station $E_1$ for causing a substrate W to be processed, such as a wafer or the like, to rotate and to move in a radial direction while detachably holding it, and a polishing head $E_2$ for causing first through fourth polishing tools 310–313, serving as a plurality of polishing tools, disposed above the polishing station $E_1$ to revolve and rotate while supporting the polishing tools 310–313.

Figure 10:
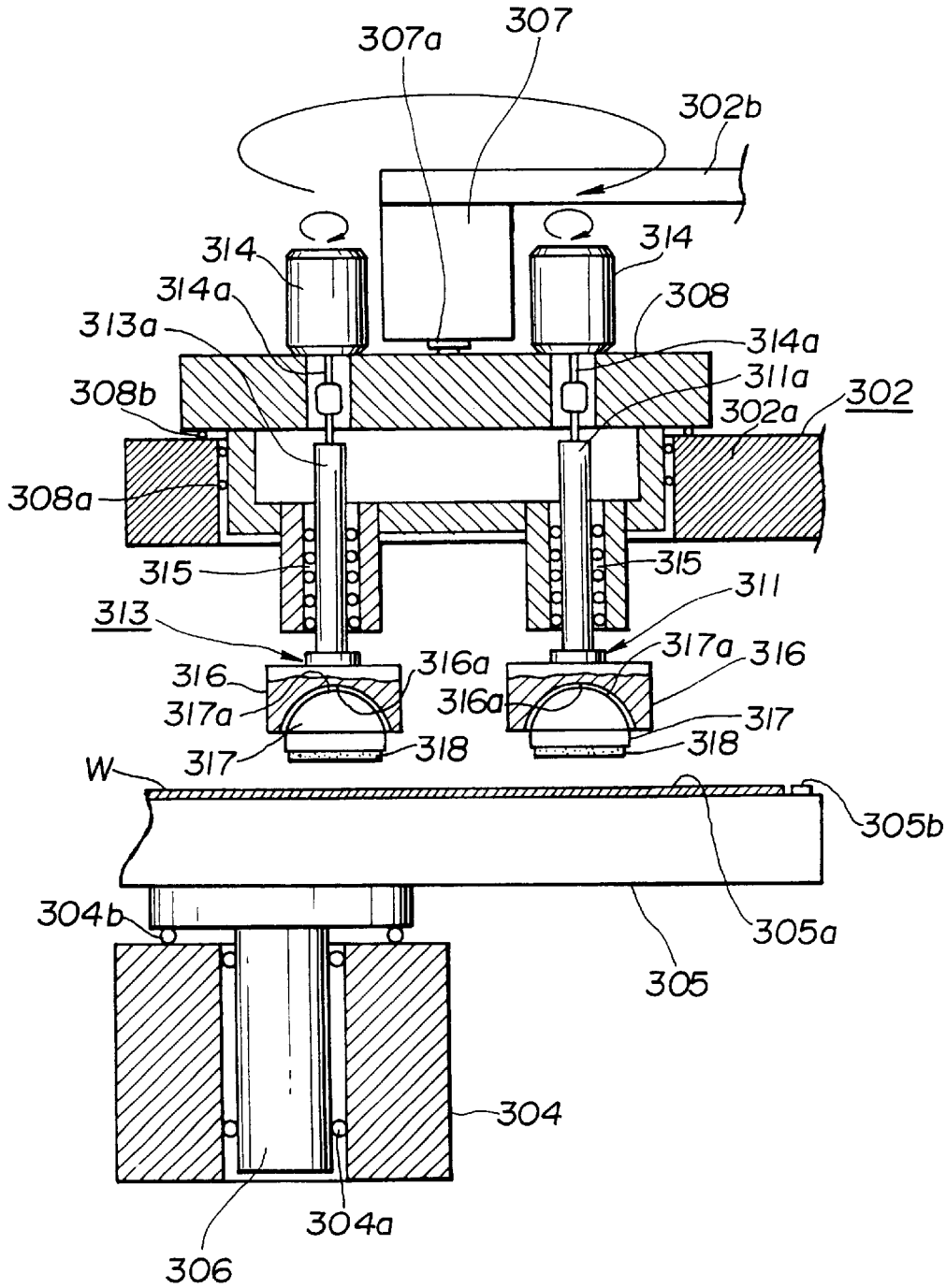
FIG. 10 is a schematic partial cross-sectional view of the chemical mechanical polishing apparatus shown is FIG. 8 taken along line II—II shown in FIG. 9.

As shown in FIGS. 8 and 10, the polishing station $E_1$ includes a slider 304 for moving a rotating table 305 in a radial direction while supporting it above on the upper surface of a guide table 303 integrally provided on a base 301, a linear driving mechanism (not shown) for moving the slider 304, the rotating table 305 whose rotation shaft 306 is rotatably supported on the slider 304 via a radial bearing 304*a* and a thrust bearing 304*b*, and a rotation driving mechanism (not shown) for rotating the rotating table 305, so as to cause the substrate W to rotate and move in a radial direction while detachably holding it on the upper surface 305*a* of the rotating table 305.

The polishing head $E_2$ includes a revolution table 308 rotatably supported on a lower yoke 302*a*, extended above the polishing station $E_1$, of a supporting member 302, planted on the base 301, via a radial bearing 308*a* and a thrust bearing 308*b*, and the first through fourth polishing tools 310–313 which are supported on four portions present with an interval on the same revolution radius on the revolution table 308 so as to be rotatable and to be movable in a radial direction via bearings 315.

The revolution table 308 is fixed on an output shaft 307*a* of a revolution-table rotation driving mechanism 307 supported on an upper yoke 302*b* of the supporting member 302, and is revolved at a predetermined revolution speed.

The first through fourth polishing tools 310–313 may have the same configuration except that they have different revolution radii. Hence, a description will be provided of the second polishing tool 311 shown in FIG. 10.

The upper end of a shaft 311*a* of the second polishing tool 311 is connected to an output shaft 314*a* of a rotation driving mechanism/linear driving mechanisms 314. A polishing-pad holding member 317 is connected to the lower end of the shaft 311*a* via a connecting member 316. A polishing pad 318 is integrally mounted on the lower surface of the polishing-pad holding member 317. It is thereby possible to cause the second polishing tool 311 to rotate at a high speed and to move in an axial direction, thereby causing the polishing pad 318 to contact the surface to be polished of the substrate W with a predetermined processing pressure or to separate from the surface to be polished of the substrate W.

The connecting member 316 and the polishing-pad holding member 317 constitute a so-called equalizing mechanism in which a convex hemispherical surface 317*a* of the polishing-pad holding member 317 is slidably fitted to a concave hemispherical surface 316*a* of the connecting member 316. Accordingly, the surface contacting the substrate W, i.e., the polishing surface, of the polishing pad 318 is inclined in accordance with the inclination of the surface to be polished of the substrate W, serving as the object to be processed.

The same reference numerals are given to the same portions of the remaining first, third and fourth polishing tools 310, 312 and 313, and a description thereof will be omitted.

Figure 9:
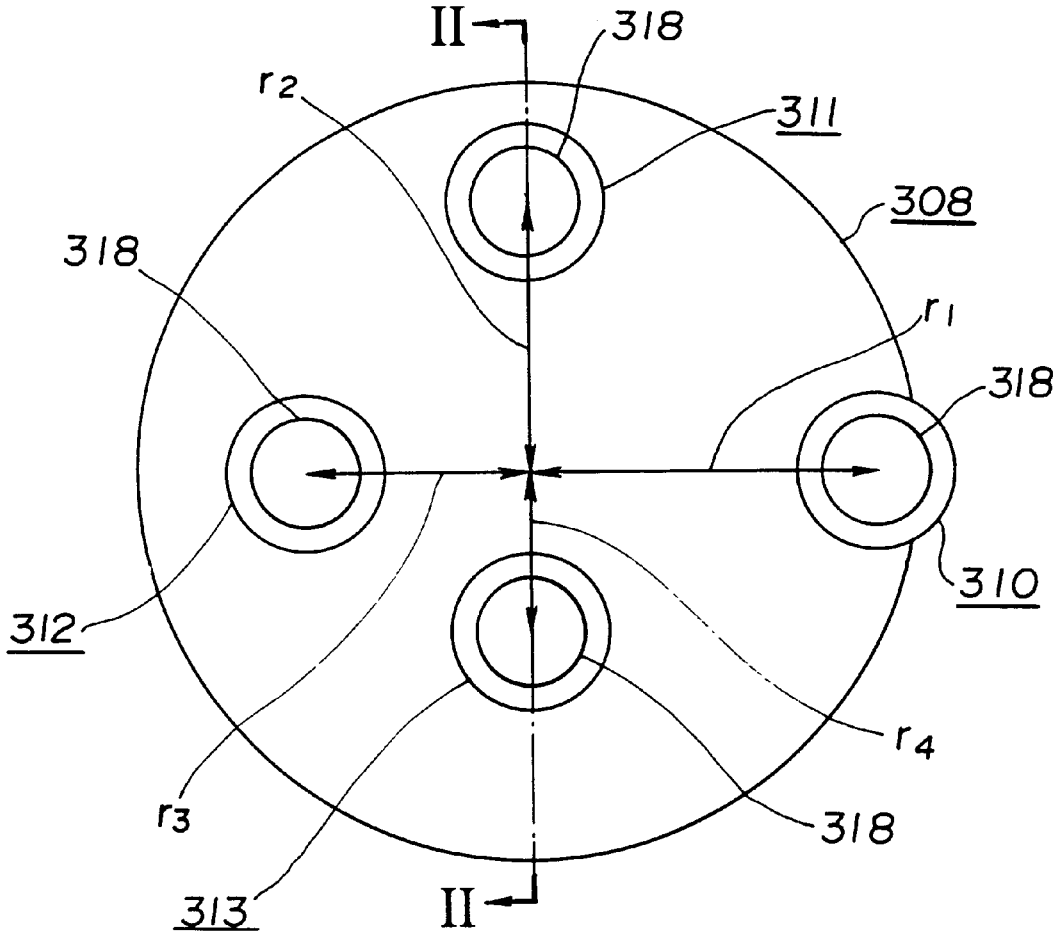
FIG. 9 is a diagram illustrating the diameters and revolution radii of respective polishing tools in the chemical mechanical polishing apparatus shown in FIG. 8.

In the third embodiment, as shown in FIG. 9, if the revolution radii of the first, second, third and fourth polishing tools 310, 311, 312 and 313 are represented by $r_1$, $r_2$, $r_3$ and $r_4$, respectively, the relationship of $r_1>r_2>r_3>r_4$ holds, and the diameters of the polishing pads of the respective polishing tools are set to be smaller than the radius of the substrate W.

Next, a description will be provided of the operation of the third embodiment.

(1) The substrate W is detachably held on the upper surface of the rotating table 305. Then, by moving the slider 304 in a radial direction, the polishing pads 318 of the first through fourth polishing tools 310–313 are set to positions where all of them contact the substrate W.

(2) Then, by moving the first through fourth polishing tools 310–313 in an axial direction toward the substrate W, the respective polishing pads 318 are brought in contact with the surface to be polished of the substrate W with a predetermined processing pressure. While supplying an abrasive (polishing slurry) from abrasive (polishing slurry) supply means (not shown) between the substrate W and the polishing pads 318, the first through fourth polishing tools 310–313 are rotated and are revolved at a high speed. At the same time, the rotating table 305 is rotated and is swung in radial directions with a short stroke to perform chemical mechanical polishing.

In the above-described processes, by setting the rotation speeds of the first through polishing tools 310–313 so that the relative circumferential speeds of the respective polishing pads 318 of the polishing tools 310–313 with respect to the substrate W have the same value, the amounts of removal by the respective polishing tools 310–313 can be unified.

Furthermore, by arranging the system such that the rotation speed and the processing pressure of each of the plurality of polishing tools can be changed, and that if a local defect, such as a projection of the like, is present on the surface to be polished of the substrate W, the rotation speed or the processing pressure of a polishing tool contacting the defect portion is set to be greater than the rotation speeds of other polishing tools, the polished surface of the substrate can be uniformly flattened.

In the third embodiment, the number of polishing tools is not limited to the above-described number, i.e., 4, but may be 2, 3 or even 5, or more. Furthermore, the rotation speed and the processing pressure of each of the polishing tools can be changed.

For example, a semiconductor wafer of Si, Ge, GaAs, InP or the like, or a quartz or glass substrate on the surface of which a plurality of island-like semiconductor regions are formed is suitable as an object to be processed according to the polishing method of the first embodiment.

All of the above-described substrates require a flat surface in order to form interconnections and insulating regions patterned using photolithography. Accordingly, the surface to be polished comprises an insulating film, a metal film, or a surface in which an insulating film and a metal film are mixed.

It is desirable to utilize the surface of a pad made of a monwoven fabric, foamed polyurethane or the like as the polishing surface of the polishing tool of the third embodiment.

A liquid containing fine particles is desirable as an abrasive used in the third embodiment. More specifically, it is desirable to use silica ($SiO_2$), alumina ($Al_2O_3$), manganese oxide ($MnO_2$), cerium oxide (CeO) or the like for the fine particles, and to use a liquid containing NaOH, KOH, $H_2O_2$ or the like as the liquid.

The diameter of the fine particles is preferably 8 nm–50 nm. The degree of agglomeration of the particles can be controlled, for example, by changing the value of pH of KOH.

When polishing the surface of a semiconductor, a sodium hydroxide solution in which silica particles are dispersed is preferable. When polishing an insulating film, a potassium hydroxide solution in which silica particles are dispersed is preferable. When polishing a metal film of tungsten or the like, an aqueous solution of hydrogen peroxide in which alumina or manganese oxide particles are dispersed is preferable.

For example, when polishing the surface of a semiconductor, if an aqueous solution of NaOH in which silica particles are dispersed is used as the abrasive, the surface of silicon reacts on NaOH to form a $Na_2SiO_3$ layer. The reaction proceeds by removing the formed layer by mechanical polishing by the silica particles and a polishing cloth to expose a new silicon surface. Accordingly, such a mechanism is called chemical mechanical polishing.

Fourth Embodiment

Figure 11:
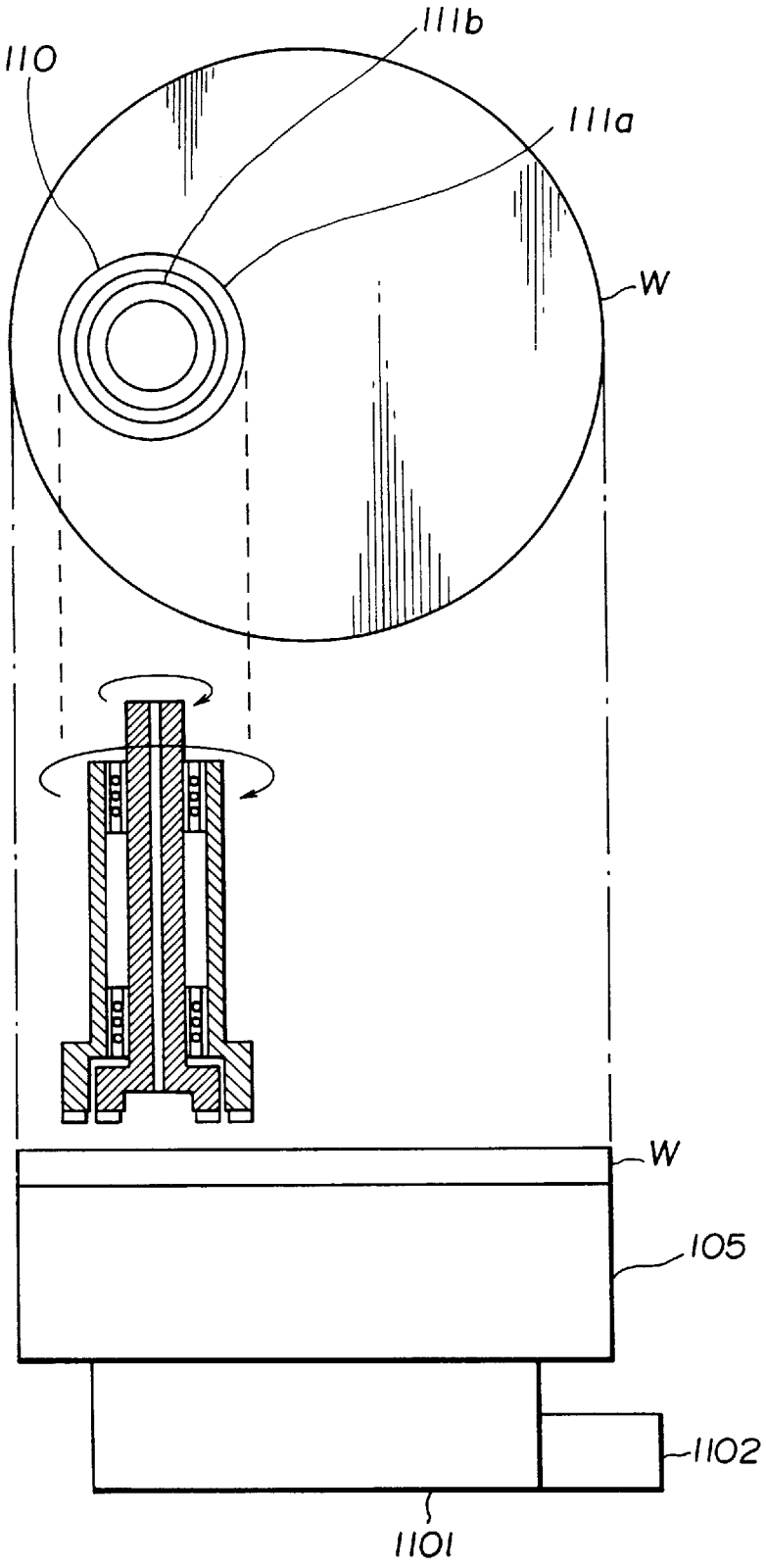
FIG. 11 is a diagram illustrating the relationship between a multiplex ring-shaped pad and a wafer in a fourth embodiment of the present invention.

In a fourth embodiment of the present invention, as shown is FIG. 11, partial polishing is performed using the multiplex ring-shaped pad described in the first embodiment. More specifically, as shown in FIG. 11, by providing a driving mechanism 1101 for moving the surface of the object to be polished relative to the multiplex ring-shaped pad for the rotating table 105, the polishing-tool unit is brought in contact with a part of the surface of the wafer, so that the surface to be polished can be entirely or partially polished using the polishing-tool unit in contact with the surface to be polished. Alternatively, by providing the driving mechanism 1101 for the multiplex ring-shaped pad and moving the multiplex ring-shaped pad, the surface to be polished can be entirely or partially polished. In another approach, by providing the driving mechanisms 1101 for both of the rotating table and the muliplex ring-shaped pad and simultaneously moving the two components, the surface to be polished can be entirely or partially polished. Furthermore, by providing a swinging mechanism 1102 for the rotating table and swinging the rotating table, complicated polishing can be performed. It is also possible to provide a swinging mechanism (not shown) for the multiplex ring-shaped pad and to swing the multiplex ring-shaped pad. It is also possible to provide the swinging mechanism for only one of the rotating table and the multiplex ring-shaped pad, or to provide the swinging mechanisms for both of these components and simultaneously swing the two components.

Fifth Embodiment

In a fifth embodiment of the present invention, the first polishing tool 210 used in the second embodiment is replaced by the multiplex ring-shaped pad described in the first embodiment.

The multiplex ring-shaped pad replaces not only the first polishing tool 210, but also may replace one of the first through fourth polishing tools, or two or three or any combination of the first through fourth polishing tools.

Sixth Embodiment

In a sixth embodiment of the present invention, the first polishing tool 310 used in the third embodiment is replaced by the multiplex ring-shaped pad described in the first embodiment.

The multiplex ring-shaped pad replaces not only the first polishing tool 310, but also may replace one of the first through fourth polishing tools, or two or three or any combination of the first through fourth polishing tools.

Seventh Embodiment

In a seventh embodiment of the present invention, the polishing tools, respectively having different diameter, are replaced in the third embodiment.

Figure 12:
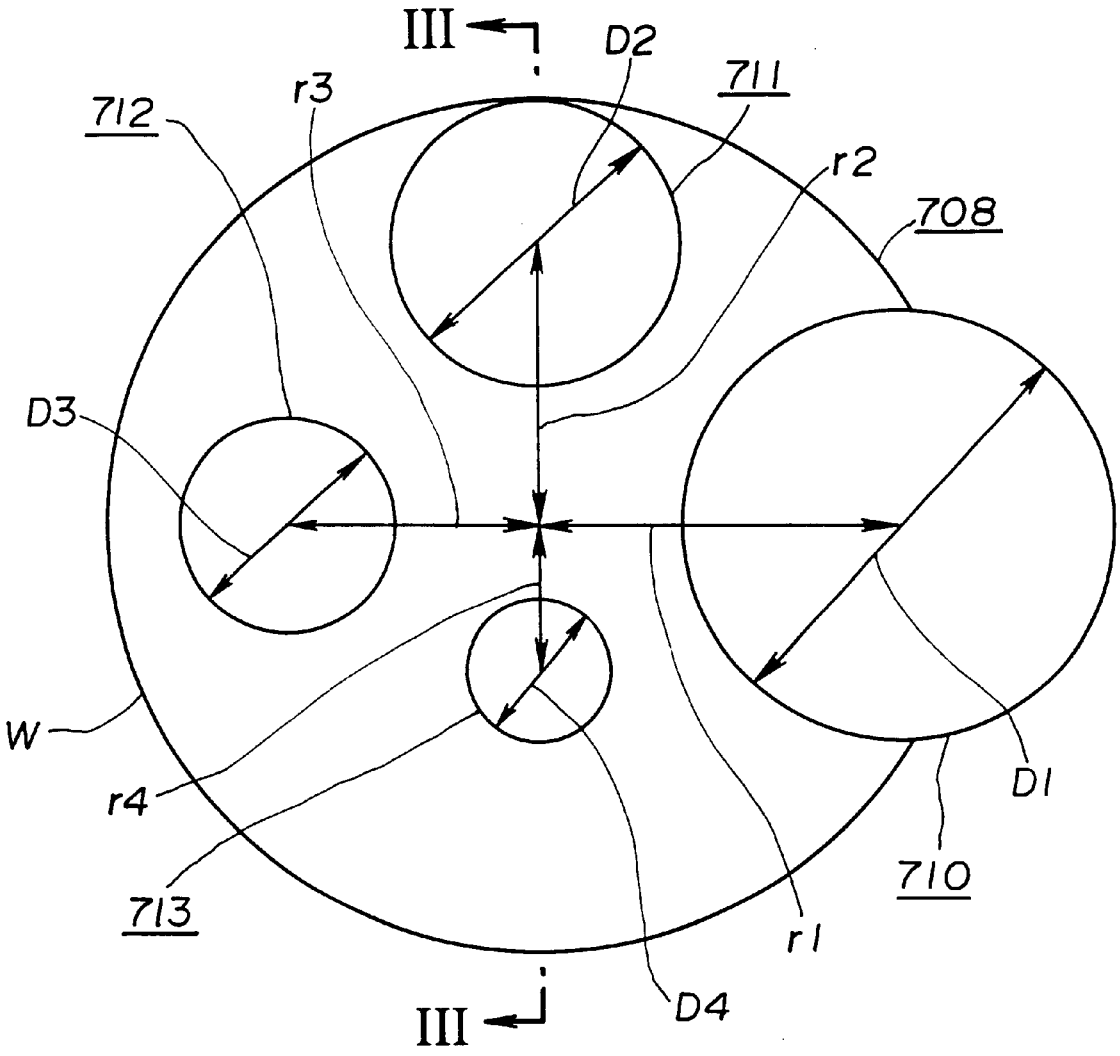
FIG. 12 is a diagram illustrating the diameters and revolution radii of respective polishing tools in the chemical mechanical polishing apparatus according to a seventh embodiment of the present invention.
Figure 13:
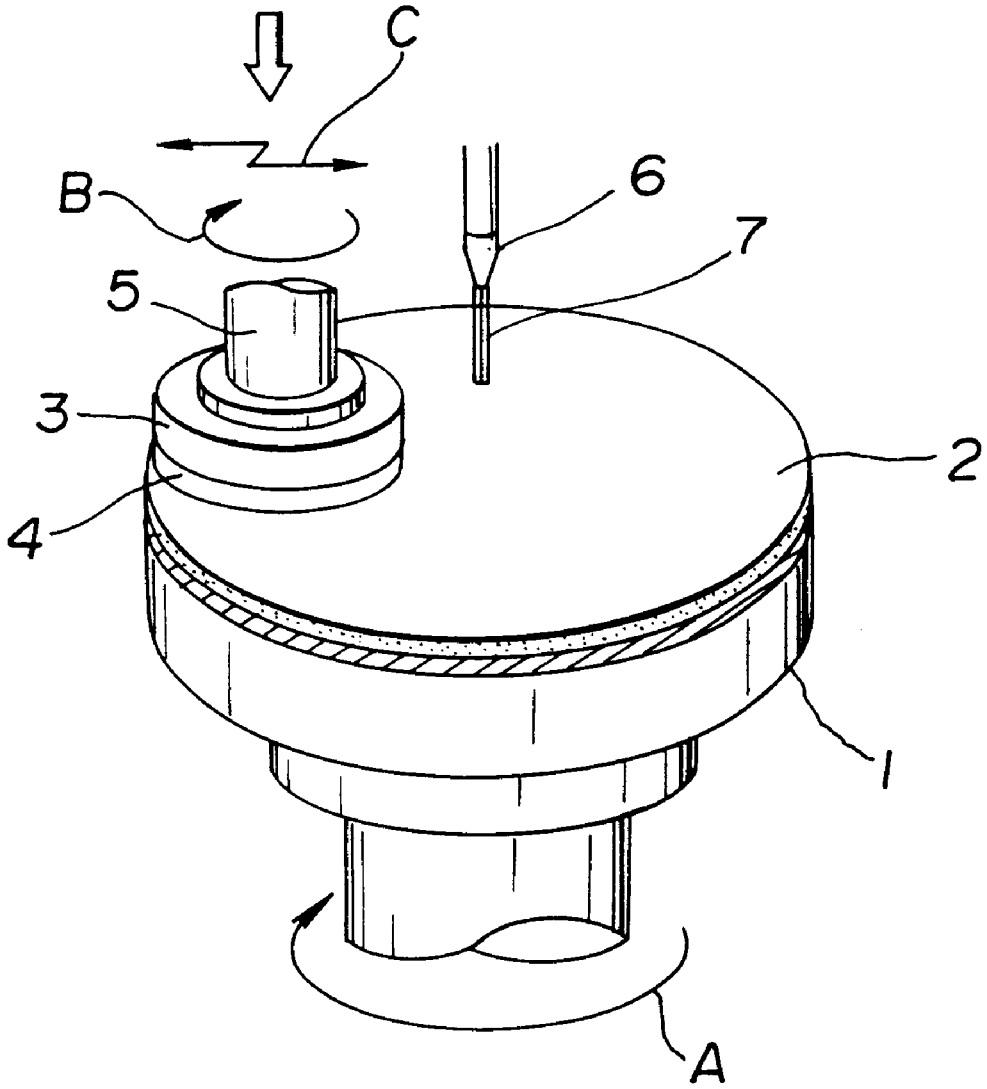
FIG. 13 is a schematic perspective view illustrating the configuration of a conventional chemical mechanical polishing apparatus.

In the seventh embodiment, as shown in FIG. 12, if the diameters of the first, second, third, and fourth polishing tools 710, 711, 712, 713 are presented by $D_1$, $D_2$, $D_3$, $D_4$, respectively, the relationship of $D_1>D_2>D_3>D_4$ holds, and the diameters of the first through fourth polishing tools 710–713 are set to be smaller than the diameter of the substrate W.

Moreover, if the revolution radii of the first, second, third, and fourth polishing tools 710, 711, 712, 713 are present by $r_1$, $r_2$, $r_3$, $r_4$, respectively, the relationship of $r_1>r_2>r_3>r_4$ holds, and the diameters of the first through fourth polishing tools 710–713 are set to be smaller than the diameter of the substrate W.

The seventh embodiment has the same operation as the third embodiment. Although in the seventh embodiment, the diameters of the respective polishing tools 710–713 are not limited to the relationship of revolution radii, $r_1>r_2>r_3$ $r_4$. The choice of the diameters of the respective polishing tools 710–713 to the relationship of revolution radii depends on each case.

And in the seventh embodiment, replacement of the polishing tool having the multiplex polishing pad to the first polishing tool 710 can be allowed. The first polishing tool 710 through the fourth polishing tool 713 can be respectively replaced to the multiplex polishing pad. And the number of the replacement of said four polishing tools is not limited to 1, but any other appropriate number may be selected.

Moreover, the number of the replacement of polishing tools is not limited to 4, but any other apprpriate number may be selected.

The individual components shown in outline in the drawings are all well-known, per se, in the chemical mechanical polishing apparatus and method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A chemical mechanical polishing method for polishing a surface of an object to be processed while supplying an abrasive between the surface to be polished and a polishing tool brought in contact with the object with a predetermined processing pressure, said method comprising the steps of:

providing a multiplex ring-shaped polishing pad, including at least first and second coaxially disposed ring-shaped polishing pads having different diameters smaller than a diameter of the surface to be polished; and rotating the multiplex ring-shaped polishing pad while contacting the object to polish the surface.

2. A chemical mechanical polishing method according to claim 1, wherein the object to be processed comprises a semiconductor.

3. A chemical mechanical polishing method according to claim 1, wherein the object to be processed comprises a semiconductor film formed on an insulating substrate.

4. A chemical mechanical polishing method according to claim 1, wherein the object to be processed has a surface to be polished comprising an insulating film and/or a metal film formed on a surface of the object.

5. A chemical mechanical polishing method according to claim 1, further comprising the step of supplying an alkaline or acidic liquid containing fine particles to the surface to be polished.

6. A chemical mechanical polishing method according to claim 2, further comprising the step of supplying an alkaline or acidic liquid containing fine particles to the surface to be polished.

7. A chemical mechanical polishing method according to claim 3, further comprising the step of supplying an alkaline or acidic liquid containing fine particles to the surface to be polished.

8. A chemical mechanical polishing method according to claim 4, further comprising the step of supplying an alkaline or acidic liquid containing fine particles to the surface to be polished.

9. A chemical mechanical polishing method according to claim 1, further comprising the step of revolving the multiplex ring-shaped pad about a central axis.

10. A chemical mechanical polishing method according to claim 1, further comprising the step of polishing the entire surface of the object with the multiplex ring-shaped polishing pad.

11. A chemical mechanical polishing method according to claim 1, further comprising the step of partially polishing the surface of the object with the multiplex ring-shaped polishing pad.

12. A chemical mechanical polising method for polishing a surface of an object, said method comprising the steps of:

preparing a plurality of polishing tools having respective polishing surfaces of different diameters smaller than a diameter of a surface to be polished; and polishing surface to be polished by causing a polishing surface of a polishing tool selected from the plurality of polishing tools to revolve and rotate while contacting the surface to be polished.

13. A chemical mechanical polishing method according to claim 12, wherein the object to be processed comprises a semiconductor.

14. A chemical mechanical polishing method according to claim 12, wherein the object to be processed comprises a semiconductor film formed on an insulating substrate.

15. A chemical mechanical polishing method according to claim 12, wherein the object to be processed has a surface to be polished comprising an insulating film and/or a metal film formed on a surface of the object.

16. A chemical mechanical polishing method according to claim 12, further comprising the step of supplying an alkaline or acidic liquid containing fine particles to the surface to be polished.

17. A chemical mechanical polishing method according to claim 13, further comprising the step of supplying an alkaline or acidic liquid containing fine particles to the surface to be polished.

18. A chemical mechanical polishing method according to claim 14, further comprising the step of supplying an alkaline or acidic liquid containing fine particles to the surface to be polished.

19. A chemical mechanical polishing method according to claim 15, further comprising the step of supplying an alkaline or acidic liquid containing fine particles to the surface to be polished.

20. A chemical mechanical polising method for polishing a surface of an object, said method comprising the steps of:

providing a plurality of polishing tools, having respective polishing surfaces of different diameters smaller than a diameter of the surface to be polished and positioned to have different revolution radii; and polishing the surface to be polished by causing a polishing surface of a polishing tool selected from the plurality of polishing tools to revolve and rotate while contacting the surface to be polished.

21. A chemical mechanical polishing method according to claim 20, wherein the object to be processed comprises a semiconductor.

22. A chemical mechanical polishing method according to claim 20, wherein the object to be processed comprises a semiconductor film formed on an insulating substrate.

23. A chemical mechanical polishing method according to claim 20, wherein the object to be processed has a surface to be polished comprising an insulating film and/or a metal film formed on a surface of the object.

24. A chemical mechanical polishing method according to claim 20, further comprising the step of supplying an alkaline or acidic liquid containing fine particles to the surface to be polished.

25. A chemical mechanical polishing method according to claim 21, further comprising the step of supplying an alkaline or acidic liquid containing fine particles to the surface to be polished.

26. A chemical mechanical polishing method according to claim 22, further comprising the step of supplying an alkaline or acidic liquid containing fine particles to the surface to be polished.

27. A chemical mechanical polishing method according to claim 23, further comprising the step of supplying an alkaline or acidic liquid containing fine particles to the surface to be polished.

28. A chemical mechanical polishing method according to claim 12, wherein at least one of the polishing tools has multiplex ring shaped polishing tools having different diameters.

29. A chemical mechanical polishing method for polishing a surface to be polished, said method comprising the steps of:

preparing a plurality of polishing tools having respective polishing surfaces of the same diameter and smaller than a diameter of the surface to be polished; and polishing the surface to be polished by causing a polishing surface of a polishing tool selected from the plurality of polishing tools to revolve and rotate while contacting the surface to be polished, wherein at least one of the polishing tools has multiplex ring shaped polishing tools having different diameters.

30. A chemical mechanical polishing method according to claim 20, wherein at least one of the polishing tools has multiplex ring shaped polishing tools having different diameters.

* * * * *

UNITED STATES PATENT AND TRADEMARK OFFICE

CERTIFICATE OF CORRECTION

PATENT NO. : 6,312,316 B1
DATED : November 6, 2001
INVENTOR(S) : Kazuo Takahashi et al.

It is certified that error appears in the above-identified patent and that said Letters Patent is hereby corrected as shown below:

Column 7,
Line 65, "and" should read -- an --.

Column 13,
Line 43, "diameter," should read -- diameters, --.

Signed and Sealed this

Twenty-third Day of April, 2002

*Attest:*

*Attesting Officer*

JAMES E. ROGAN
*Director of the United States Patent and Trademark Office*